US005729831A

United States Patent [19]

Kuhlmann

[11] Patent Number: 5,729,831

[45] Date of Patent: Mar. 24, 1998

[54] PROTECTIVE GLOVE

[75] Inventor: Gerhard Kuhlmann, Mühlacker, Germany

[73] Assignee: Friedrich Münch GmbH & Co. KG., Mühlacker, Germany

[21] Appl. No.: 737,753

[22] PCT Filed: May 9, 1995

[86] PCT No.: PCT/EP95/01746

§ 371 Date: Nov. 8, 1996

§ 102(e) Date: Nov. 8, 1996

[87] PCT Pub. No.: WO95/30346

PCT Pub. Date: Nov. 16, 1995

[30] Foreign Application Priority Data

May 9, 1994 [DE] Germany ..... 44 16 389.4
Sep. 30, 1994 [DE] Germany ..... 94 15 816.9 U

[51] Int. Cl.[6] ..... A41D 13/10

[52] U.S. Cl. ..... 2/16; 2/159; 2/161.6; 2/167

[58] Field of Search ..... 2/158, 159, 160, 2/161.1, 161.5, 161.6, 162, 163, 167, 169, 16

[56] References Cited

U.S. PATENT DOCUMENTS

| | | | |
|---|---|---|---|
| 629,901 | 8/1899 | Greenstreet | 2/158 X |
| 4,388,733 | 6/1983 | Anstett | 2/162 X |
| 4,471,495 | 9/1984 | Kruse et al. | 2/162 |
| 4,493,865 | 1/1985 | Kuhlmann et al. | 2/167 X |
| 4,750,218 | 6/1988 | Ziegler . | |
| 4,841,577 | 6/1989 | Lars-Jos | 2/161.8 X |
| 4,843,650 | 7/1989 | Kangas et al. | 2/159 |
| 5,054,126 | 10/1991 | Rivkin . | |
| 5,088,123 | 2/1992 | MacDonald . | |
| 5,511,241 | 4/1996 | Ziegler | 2/161.6 X |

FOREIGN PATENT DOCUMENTS

| | | |
|---|---|---|
| 9113608 | 10/1991 | Germany . |
| 9305286 | 4/1993 | Germany . |
| 9313344 | 9/1993 | Germany . |

*Primary Examiner*—C. D. Crowder
*Assistant Examiner*—Shirra L. Jenkins
*Attorney, Agent, or Firm*—Dvorak & Orum

[57] ABSTRACT

A protective glove is made of fabric of interwoven metal rings. The metal rings are interwoven in such a way that the fabric is substantially more flexible, without forming folds, in a longitudinal direction (L) than in a perpendicular direction thereto. The longitudinal direction (L) is the longitudinal direction of the fingers. The protective glove is further provided in the area of the wrist with a slot oriented towards the fingers and bridged by a closing strip arranged on the glove. The closing strip is also made of interwoven metal rings and is interwoven with the glove.

20 Claims, 6 Drawing Sheets

PROTECTIVE GLOVE

Figure 1:
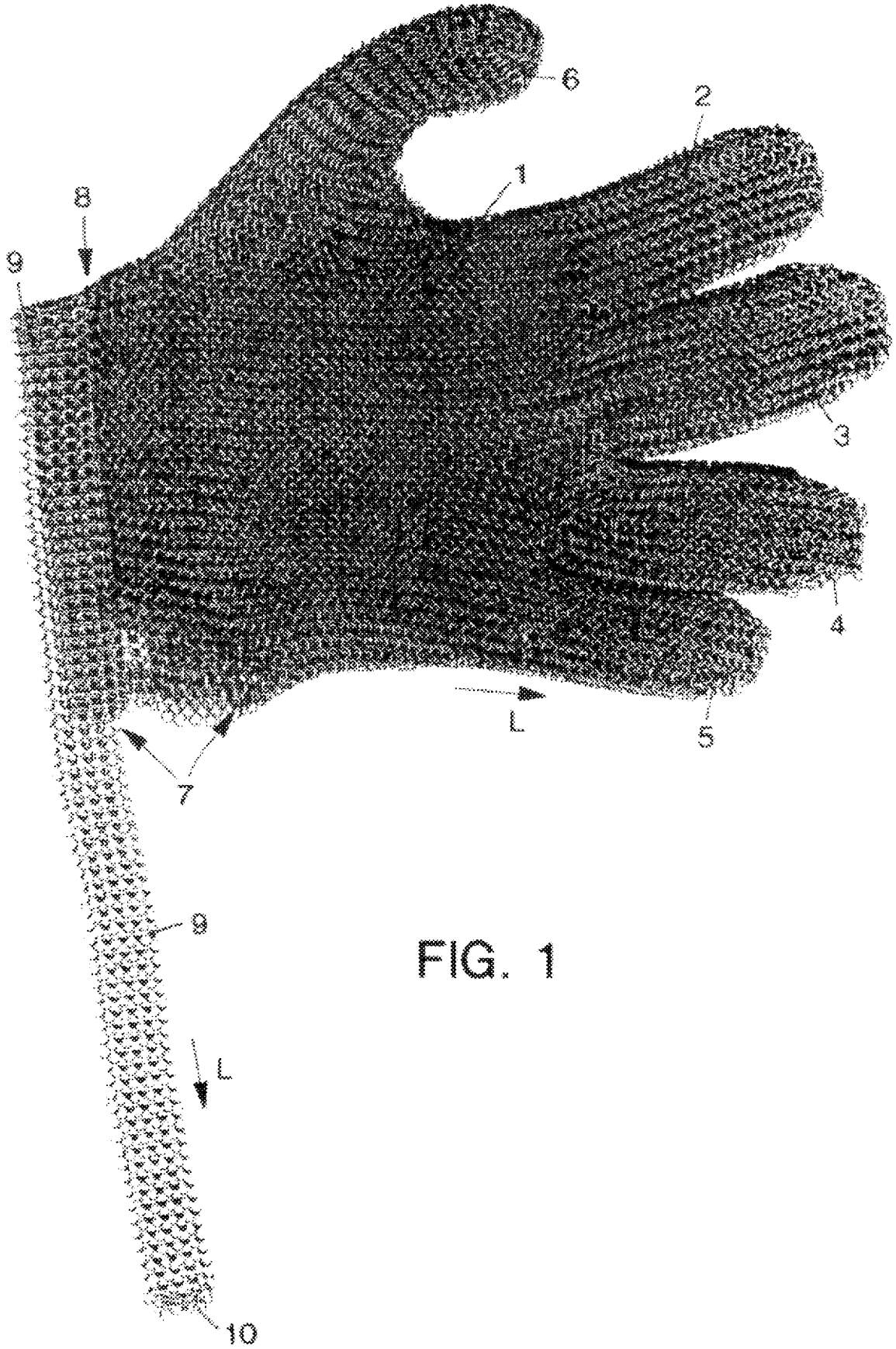

The invention relates to a protective glove having the characterising features set out in the preamble of claim 1. Such gloves are known from DE 91 13 608 U1 and are worn by butchers, for example, as a form of protection against gashes, cuts and similar injuries. Metal-ring meshed materials of this type are extremely flexible and leave the hand they are intended to protect free to move. However, the high degree of flexibility of the metal-ring mesh does have one disadvantage in that, unlike a glove made from leather or a textile fabric, a glove of this type can easily slip off the hand unless it is secured at the wrist. The gloves are therefore provided with a fastening strap, which usually bridges a slit in the wrist area of the gloves, provided to make it easier to put on and remove the gloves and ensure they can be fastened without any folds.

Known straps of this type are made from a thermoplastic fabric, e.g. polyamide, and an edge of the metal-ring mesh is welded into the wrist area. This fabric strap is generally provided with a push-stud mechanism to retain the glove.

Another known method is to embed the edge of the metal-ring mesh in a silicon band, which is applied to the metal ring mesh by a spray technique.

The disadvantage of these bands is the fact that they are very-difficult to clean, especially if they have started to wear, which is particularly problematic when used for handling foodstuffs. Once the bands have become worn, the gloves either have to be thrown away or returned to the manufacturer to have new bands fitted. This is quite a simple process, however, since the bands are welded or sprayed onto the metal-ring mesh.

In order to avoid these drawbacks, gloves are already known where inter-changeable fastening straps made from plastics are provided. For this purpose, there are two layers of the metal-ring mesh in the wrist area so as to form runners through which the fastening strap can be pulled. This means that it is possible to remove the straps from the metal-ring mesh for cleaning. Cleaning on a daily basis, however, is rather inconvenient and there is the added difficulty that the runners are particularly difficult to clean.

A glove is also known from DE 91 13 608 U 1, which is fastened by means of a cuff made from perforated metal plates. However, the cuff restricts wrist movement. If designed so that the cuff starts after the wrist, however, and the metal ring mesh of the glove extends over the wrist, it is necessary to provide a separate fastening band and this has the disadvantages outlined above.

The objective of the present invention is to provide a glove that does not restrict movement, whereby the soiled gloves are less of a problem to clean and worn fastening straps easier to change than is the case with the known protective gloves made from a metal ring mesh.

This objective is achieved by means of a glove having the characterising features of claim 1. Advantageous embodiments of the invention are described in the dependent claims.

The glove of the invention resolves the problem by dint of the fact that it does not use a fastening strap made of plastics, leather or similar, but a fastening strap that is also made from a metal-ring mesh and is interlinked with the glove so that the glove and its fastening strap are integrally joined to one another. This feature, which makes it distinctive as compared with the prior art, overcomes the problems outlined above and offers several advantages:

Unlike the prior art, the fastening strap is subjected to less rather than more wear than the remainder of the glove.

Due to the fact that there is less wear, the fastening strap never needs to be changed.

Since the glove and the fastening strap are made integrally from a metal-ring mesh, it is much more hygienic than the known gloves. Since the metal rings, generally made from stainless steel, have a smooth surface with no pores, the glove can be kept clean much more easily than a glove with a strap made from plastics, whose surface becomes rough and torn over time.

The glove can be mechanically and chemically treated with strong cleaning products as required (detergents, solvents, powerful brushes), which could not be used with plastics.

The gloves of the invention are unaffected by cleaning using machine methods.

The gloves of the invention can also be cleaned by high-pressure water jets and steam-jet devices and sterilised at high temperatures without problems.

There are no difficult-to-clean runners formed by a double layer of metal ring mesh.

The gloves with the fastening strap of the invention can be secured in a very simple manner. In the most simple of cases, it is sufficient to provide clamps joined to one another by a short rubber strap for this purpose, of the type commonly used to secure stretchable dressings used for medical purposes. These clamps have claws, which are extremely easy to link to the metal-ring mesh. Such clamps are extremely cheap; they cost a few pence and can be simply thrown away when they are no longer usable. However, it is also possible to provide one or several claws on the fastening strap itself, which can be hooked into the metal-ring mesh in order to fasten the glove. Instead of using such clamps, it is also possible to use pins with an undercut, e.g. shaped, so that they can be easily hooked into the metal-ring mesh. If several claws or pins are provided, they will have a special common rigid base to facilitate the hooking and releasing of the claws or pins onto or from the metal ring mesh.

Another option is to have a metal clamp, in particular a clip, which is pushed to the side over the end of the fastening strap so that the end of the fastening strap can be clamped together with the layer of the metal-ring mesh lying underneath it.

The glove of the invention is particularly efficient in terms of handling if the direction of the grain of the metal-ring mesh in the fastening strap runs at right angles to the grain of the metal-ring mesh of the adjoining glove. With the grain running in this direction, the metal-ring mesh can be pulled together to a relatively large degree without folding, whereas this is not the case where the grain is at a right angle. Gloves are generally cut so that the grain runs in the longitudinal direction coinciding with the fingers, which means that the metal-ring mesh readily follows finger movement. The fastening strap is preferably cut in the direction at right angles thereto, namely in the circumferential direction around the wrist. This design has additional advantages:

The width of the fastening band remains practically the same in every situation, since the fastening band hardly bunches up at all transversely to the direction of the grain.

The seam of the glove in the wrist area is stabilised thereby.

Since the rings are arranged in a successive zig-zag pattern along the grain, the layers of the fastening strap lying one above the other interlink when the fastening strap is wound around the wrist and this interlinking makes the fastening of the glove extremely secure without the fastening strap having to be stretched because of the large number of metal rings interlocking with one another in a scale-like design.

Because of this reciprocal interlinking of the rings, the fastener, by which the tip of the fastening strap is finally fastened, is not subjected by an tractional stress which means that it does not have to be particularly strong. One or two pins or claws mounted on the tip of the fastening strap will be absolutely sufficient to retain the tip of the fastening strap on the portion of the fastening strap lying underneath it. It is sufficient to provide a small pin, for example, which can be inserted in the the last row of metal rings at the tip of the fastening strap and which has a claw at each of its ends. The claws have a dual function since they are used both to secure the tip of the fastening strap to the portion of the strap lying underneath and are used to secure the small pin in the fastening strap as well. A basic type of fastening such as this also has advantages in terms of hygiene since there are no cavities that would be difficult to clean.

The ability of the fastening strap to interlock with itself is also unaffected if the glove is turned inside out. A glove of the invention can therefore be used for the right hand or the left hand without any modification if it is turned inside out and vice versa. It is easy to use a glove made from a metal-ring mesh in this way due to the fact that it is highly flexible. In a preferred embodiment of the invention, the means provided on the tip of the fastening strap to fasten the strap are such that they can be used irrespective of whether the glove is worn on the right hand or the left hand. This is possible, for example, if claws or pins are provided on both sides of the fastening strap, i.e. on the upper face and on the lower face, which can be inserted in the rings of the fastening strap located directly underneath them. For this purpose, the pins preferably have a ball-shaped head which retains them in the metal-ring mesh on one side but are not uncomfortable provided they are not protruding to the exterior. A particularly firm hold can be produced with claws. To ensure that none of the claws needs to protrude on the exterior, the claws are appropriately arranged facing one another on the same side of the plate and, so that it can be linked to the fastening strap, this plate has a row of holes between the oppositely arranged claws into which a row of rings on the tip of the fastening strap, preferably the last row of rings, can be linked. This plate can then be pivoted from one or the other side around the tip of the fastening strap as required. Because the claws are arranged facing one another, there is at least one which can be hooked into the metal-ring mesh whether worn on the right hand or the left hand, in order to secure the tip of the fastening strap.

The fastening strap should be long enough to wrap around the wrist without problems irrespective of wrist size. If the fastening strap is two to three times longer than the seam of the glove in the wrist area, the metal-ring mesh is necessarily very densely interlinked on itself. When arranged around the wrist, the fastening strap basically sits on its own surface area, which produces a highly effective reciprocal interlinking. Adequate interlinking is also produced, however, if the fastening strap covers a length of only a few centimeters of its own length.

Some protective gloves made from metal-ring mesh do not end at the wrist but are additionally extended by a cuff made from metal-ring mesh, which may be several centimeters in length but may also extend as far as the elbow. Two fastening straps are generally provided on gloves of this type, one in the wrist area in the transition area between the actual glove and the cuff and another fastening strap on the far end of the cuff. For this type of glove with a cuff, a further embodiment of the invention provides two fastening straps made from metal-ring mesh. However, it is possible to provide only one fastening strap extending from the cuff, preferably from the full length thereof. It may then taper, e.g. to a point, and be fastened with only one fastener. By preference, the width of the fastening strap matches that of the cuff and is fastened by at least two fasteners. Preferably, the fastening straps and the cuff are of a metal-ring mesh running in the same direction, around the Two embodiments of the invention are illustrated in the drawings.

Figure 2:
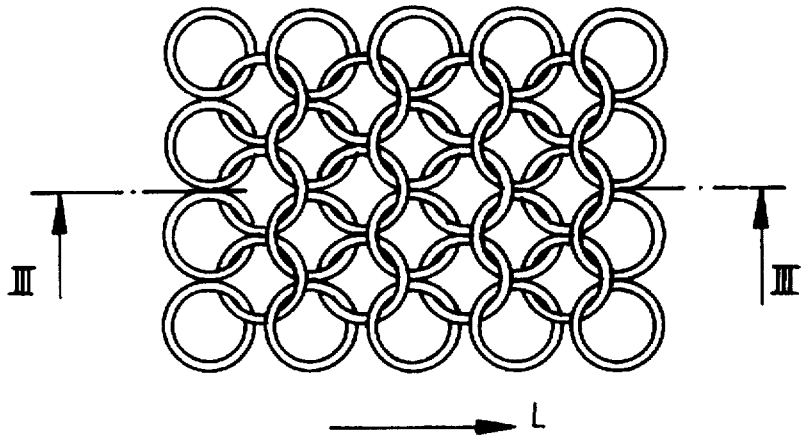
Figure 3:
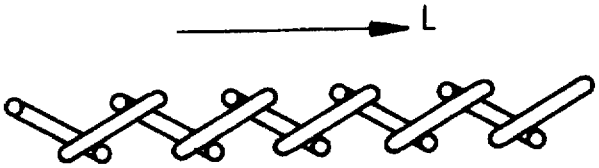
Figure 4:
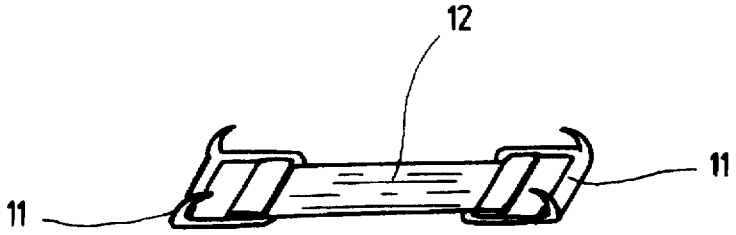
Figure 5:
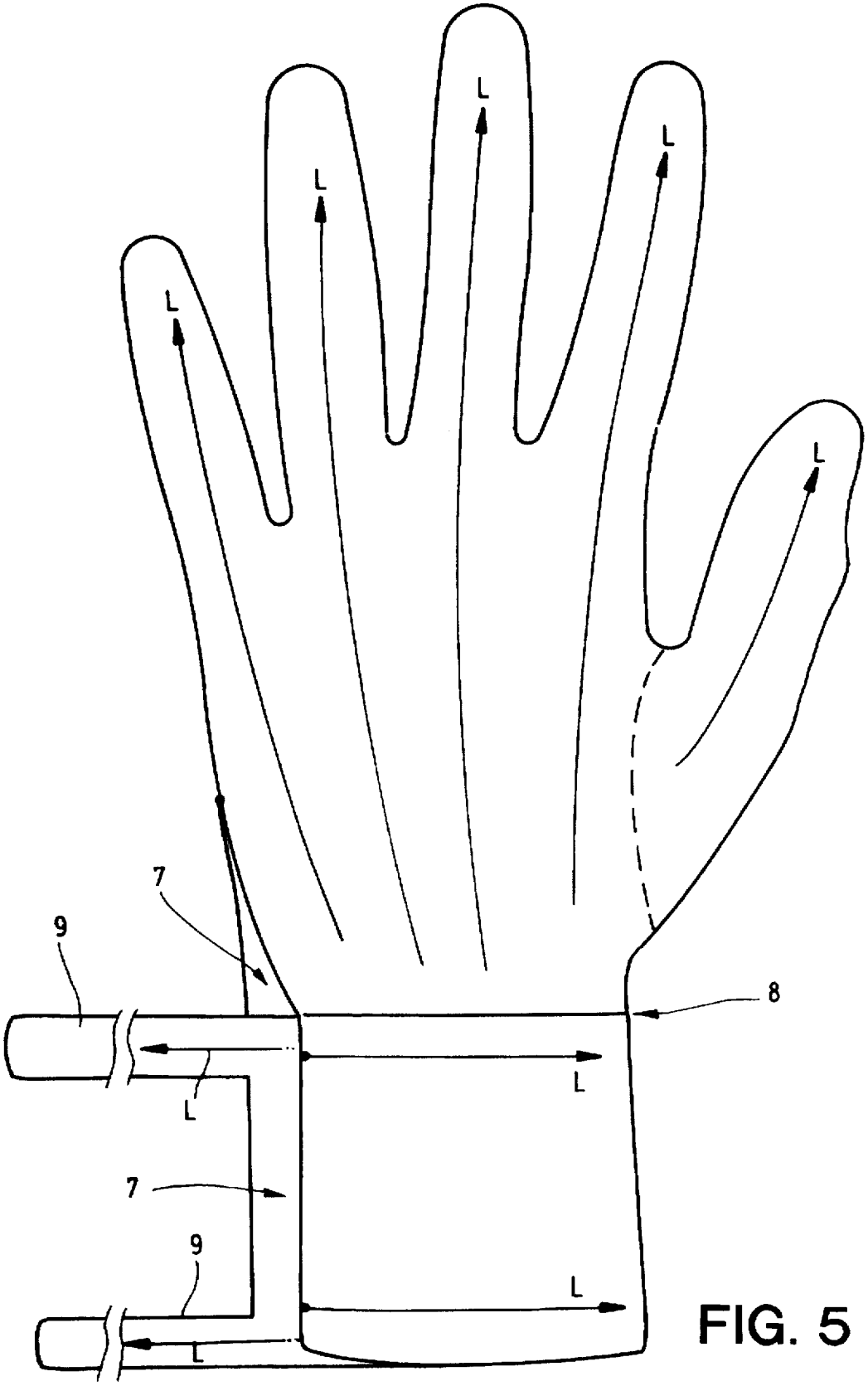
Figure 6:
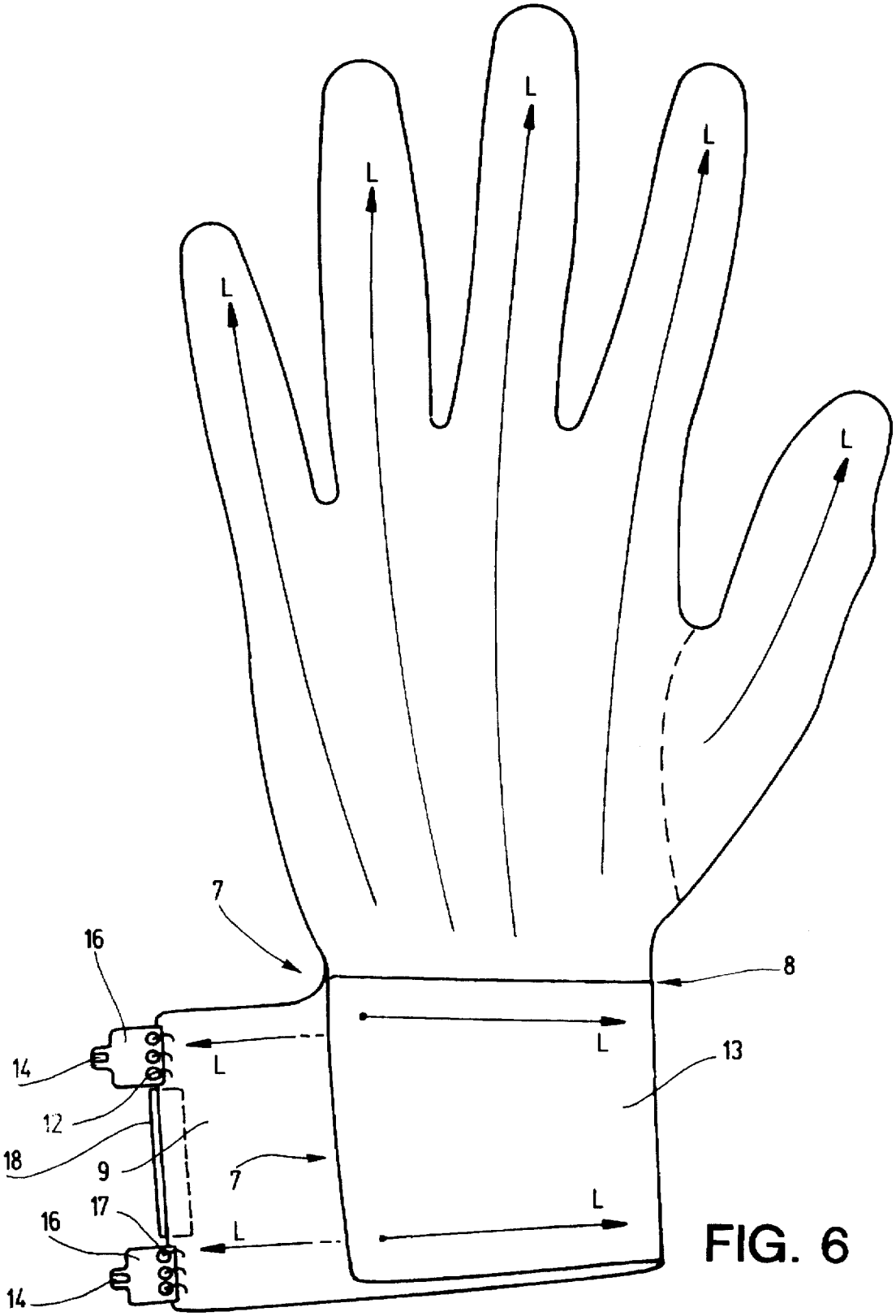
Figure 7:
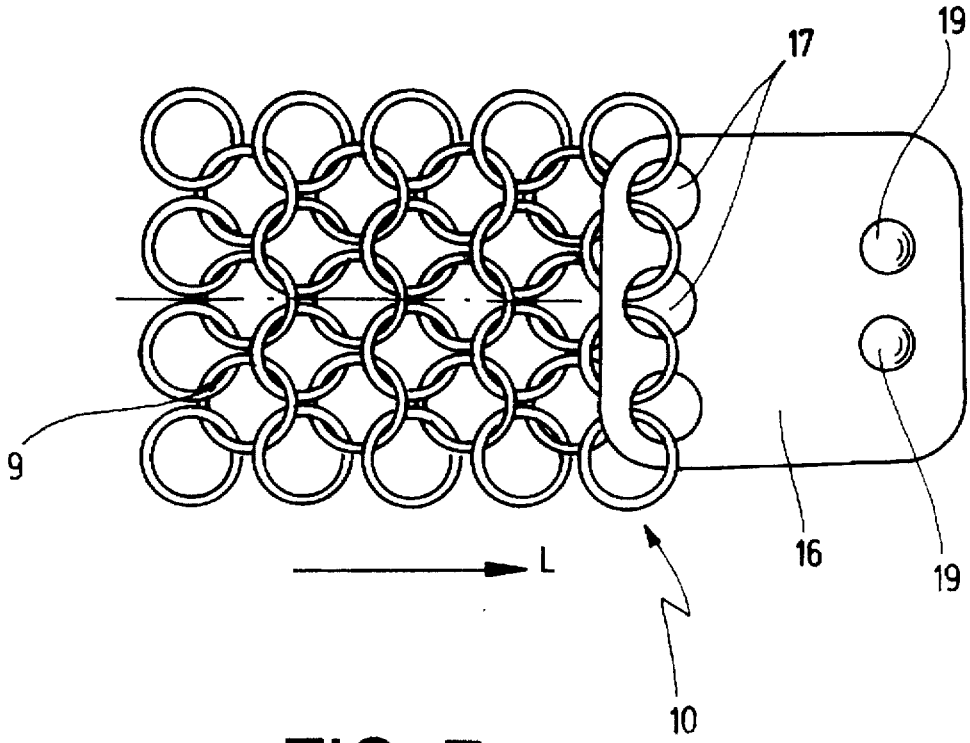
Figure 8:
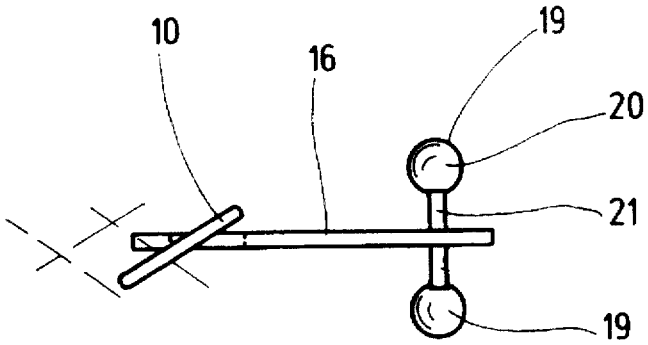
Figure 9:
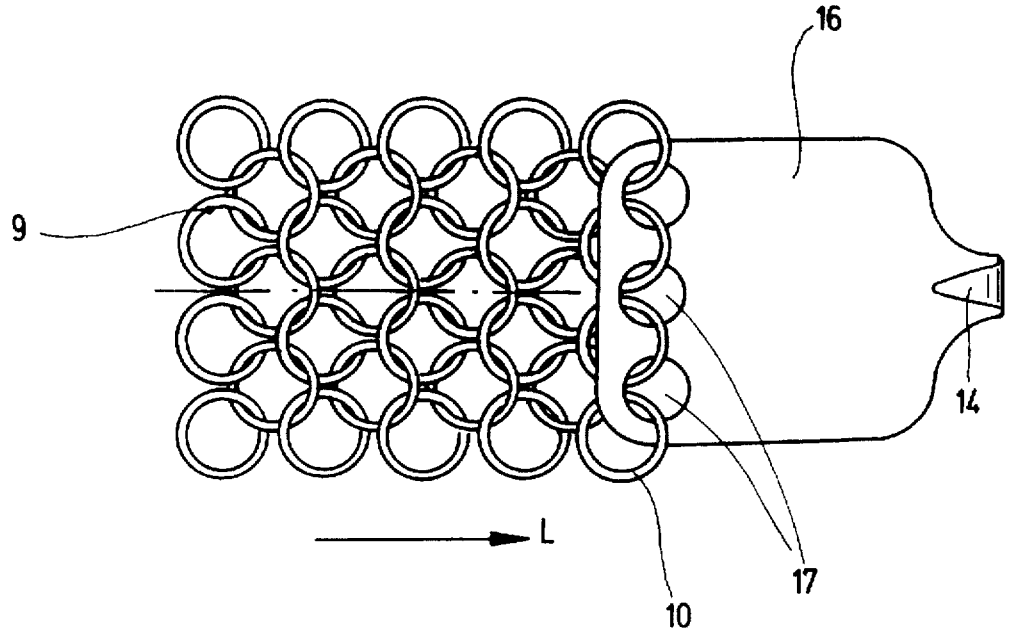
Figure 10:
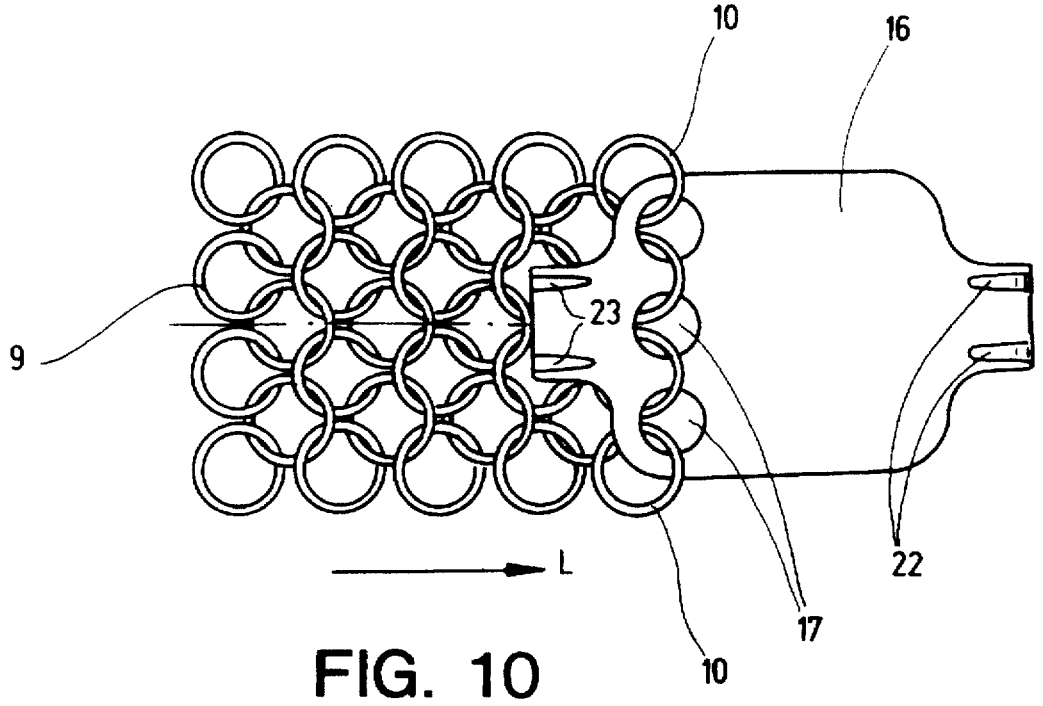

FIG. 1 shows a view of a glove without a cuff,

FIG. 2 shows an enlarged detail of a section of the metal-ring mesh of the glove, FIG. 3 shows a section along the line III—III through the mesh, FIG. 4 shows the side view of a clamp for fastening the strap of the glove, FIG. 5 shows a view of the a glove with a cuff and two fastening straps, FIG. 6 shows a view of a glove with a cuff and a broad fastening strap, FIG. 7 shows the tip of a fastening strap, on which a metal plate with pins is provided, viewed from above, FIG. 8 shows a side view of the plate of FIG. 7, FIG. 9 shows the tip of a fastening strap with a plate mounted thereon, having a hook, viewed from above, and FIG. 10 shows the tip of a fastening strap with the reversible plate, on which hooks are arranged facing one another.

The glove illustrated in FIG. 1 consists of a metal-ring mesh, the grain L of which in the region of the inner hand surface 1 and the four fingers 2 to 5 runs in the longitudinal direction of the fingers and in the thumb area 6 in the longitudinal direction thereof. In the area of the outer edge of the hand, the glove is provided with a slit 7 making it easier to put the glove on or remove it. Attached at the seam 8 of the mesh, whose grain direction runs in the longitudinal direction of the fingers 2 to 5, is a strap 9, which is made of a metal-ring mesh constructed in the same way but whose grain L runs in the direction transverse to that of the mesh in the adjoining glove. The strap 9 is linked to the mesh of the glove; the portion of the strap 9 extending beyond the slit 7 is about twice as long as the portion of the strap that is linked to the glove.

FIG. 2 illustrates how the metal-ring mesh of the glove is constructed and how the fastening strap 9 is linked to it. Apart from the edges and seams, each ring in the mesh is linked with four adjacent rings. Reference L indicates the grain in FIG. 2. In the direction of the grain L, the mesh can be pushed together easily without folding to less than half its original length. It is virtually impossible to push the mesh together in the direction at right angles to the grain L.

In cross-section, the mesh illustrated in FIG. 3 is of a zig-zag design. Clearly two layers of the mesh with matching grain placed one on top of the other can be linked to one another in a scale-type construction. This linking action occurs when the strap 9 of the glove is wrapped around the wrist for fastening. The inter-linking prevents the glove from opening up. The clamps illustrated in FIG. 4, for example, can be used to lay the tip 10 of the fastening strap 9 secure against the portion of the strap lying underneath, and consist of two double claws 11 joined to one another by means of a rubber strap 12 so that they can easily be hooked into the metal-ring mesh.

The glove illustrated in FIG. 5 is made from a metal-ring mesh of the same type as that shown in FIG. 1. Unlike that glove, not only is there a fastening strap attached to the seam 8 of the glove lying at the wrist but also a cuff 13, which has a fastening strap 9 on each of its two ends. The grain L of the mesh in the cuff 13 and the fastening straps 9 runs around the arm, transversely to the direction of the grain in the hand surface. The slit 7 extends from the outer edge of the hand up to the far end of the cuff.

As with the glove shown in FIG. 5, the glove illustrated in FIG. 6 has a cuff 13, which does not have two narrow fastening straps but instead continues as a broad fastening strap 9, the width of which essentially matches the length of the cuff. The front edge of the fastening strap is joined with two claws 14, which project out from a small metal plate 16 with holes 17 linked to the mesh of the cuff 13 and which are punched and shaped in the metal. The fastening strap 9 is relatively short and surrounds the wrist with a medium-sized overlap. However, it is also possible for the fastening strap to be wrapped fully round the wrist so as to provide additional protection and wrist support.

The metal-ring mesh between the small plates 16 is stiffened by means of a strip 18 of a silicon plastics material, which is moulded to conform with the mesh, passing therethrough and covering both sides.

In addition to the oppositely arranged interlinking of the metal rings of two layers of the fastening strap one on top of the other, the fastening strap 9 is preferably secured by means of a special fastening component provided at the tip 10 of the fastening strap. In the embodiment shown in FIGS. 7 and 8, the fastening component is made from a thin metal plate, measuring 15 mm in width by 20 mm in length and having a row of holes 17 close to one of its edges, in particular three or four holes 17, which are linked to the last rings in the tip 10 of the fastening strap. Near the oppositely lying edge of the plate 16, four pins 19 are provided thereon, two on the front face and two on the rear face, each of these comprising a ball-shaped head 20 and a slimmer shaft 21. The diameter of the head 19 is such that it can be inserted through a ring of the metal ring mesh, after which the ring is located in the area of the body and cannot easily slip back over the head 20. Since the pins are located on both sides of the plate 16, the fastener can be used both if the glove is worn on the left hand and if the same glove is worn on the right hand.

The embodiment of a fastener illustrated in FIG. 9 is substantially different from the embodiment illustrated in FIGS. 7 and 8 in that instead of the pins 19 on the edge of the plate 16, the oppositely lying holes 17 are provided only with hooks 14, which can be hooked therein to secure the end 10 of the fastening strap 9.

The embodiment illustrated in FIG. 10 differs from the embodiment of FIG. 9 in that instead of the simple hooks 14, a double hook 22 is provided and on the same side of the plate 16 a double hook 23 is provided opposite and facing the double hook 22. Only one of the double hooks 22 and 23 is used to fasten the fastening strap, one of the double hooks if the glove is worn on the left hand and the other double hook if the glove is worn on the right hand. In the design illustrated in FIG. 10, the double hook 22 is used as the fastener. If the glove is reversed, so that it can be worn on the other hand, the plate 16 is also reversed so that, as illustrated in the view of FIG. 10, it is pivoted about the tip 10 of the fastening strap so that the greater part of the plate 16 lies against the metal ring mesh of the fastening strap 9, so that the double hooks 22 and 23 are located underneath the plane as viewed in the direction shown in FIG. 10; the double hook 23 is then located in a different position from that of FIG. 10 in front of the tip 10 of the fastening strap and can be used to hook into the layer of the fastening strap on which it lies.

With the fasteners illustrated in FIGS. 7, 8 and 10, the glove of the invention can be used at any time and worn on either the right hand or the left hand, the tip of the fastening strap being secured in its closed position without problems in either case.

I claim:

1. A protective glove formed of a metal-ring mesh, wherein the rings are linked to one another to permit the mesh to be pushed together in the direction of the grain, without folding, to a greater extent than in a direction running at right angles thereto, and wherein the grain runs in a longitudinal direction of the fingers, comprising a slit in the area of the wrist, extending in the direction of the fingers, and a metal fastening strap which bridges the slit, and is linked to the glove, and wherein said fastening strap is formed of metal-ring mesh.

2. A protective glove as claimed in claim 1, wherein the grain of said fastening strap extends at right angles to the grain of the glove to which it is adjoined.

3. A protective glove as claimed in claim 2, comprising a seam on the fastening strap that joins the entire length of the glove at the wrist.

4. A protective glove as claimed in claim 2, wherein the fastening strap has a portion at one side extending beyond said slit.

5. A protective glove as claimed in claim 3, wherein said fastening strap is two to three times the length of said seam of the glove.

6. A protective glove as claimed in claim 1, comprising a cuff formed of metal-ring mesh, and a fastening strap is attached along the full length of said cuff.

7. A protective glove as claimed in claim 1, comprising a cuff formed of metal-ring mesh and a fastening strap formed of metal-ring mesh attached at both ends of said cuff.

8. A protective glove as claimed in claim 6 wherein the grain of the metal-ring mesh of said cuff and of the fastening straps match one another and extend around the arm.

9. A protective glove as claimed in claim 1, wherein an elastomer strap provided with claws at each of its ends for closing the fastening strap.

10. A protective glove as claimed in claim 1, comprising one or more clamps secured to the tip of said fastening strap.

11. A protective glove as claimed in claim 1, comprising one or more pins with an undercut are provided at the tip of said fastening strap, and extend transversely of the metal-ring mesh.

12. A protective glove as claimed in claim 6, comprising claw or pin means disposed close to the front and rear edge of said fastening strap, whereby the orientation from the rear to the front is determined by the longitudinal direction of the lower arm.

13. A protective glove as claimed in claim 10, wherein said clamps have a common rigid base.

14. A protective glove as claimed in claim 10, wherein said claws are provided on both the upper face and the under face of said fastening strap.

15. A protective glove as claimed in claim 11, wherein said pins are provided on both the upper face and the under face of said fastening strap.

16. A protective glove as claimed in claim 13, wherein said pin or claw means comprise a plate forming a base, which is linked to only one row of rings of said fastening strap, preferably the last row of rings at the tip of said fastening strap.

17. A protective glove as claimed in claim 16, wherein said plate includes claws facing one another on the same side of the plate and the plate has a row of holes between the oppositely lying and facing claws, by means of which they are linked to the rings of said fastening strap.

18. A protective glove as claimed in claim 7 wherein the grain of the metal-ring mesh of said cuff and of the fastening straps match one another and extend around the arm.

19. A protective glove as claimed in claim 11, comprising claw or pin means disposed close to the front and rear edge of the said fastening strap, whereby the orientation from the rear to the front is determined by the longitudinal direction of the lower arm.

20. A protective glove as claimed in claim 11, wherein said pins have a common rigid base.

* * * * *